United States Patent [19]

Johnston

[11] 3,972,553

[45] Aug. 3, 1976

[54] COLLAPSIBLE LIFT FRAME HAVING MEANS TO ADJUST POINT OF LIFT

[75] Inventor: Clifford V. Johnston, Hebron, Ohio

[73] Assignee: Cardinal Industries Incorporated, Columbus, Ohio

[22] Filed: Nov. 14, 1975

[21] Appl. No.: 631,932

[52] U.S. Cl. ..... 294/67 DA; 294/81 R

[51] Int. Cl.[2] ..... B66C 1/10

[58] Field of Search ..... 224/45 F, 50; 294/81 R, 294/81 SF, 67 R, 67 A, 67 AA, 67 D, 67 E, 67 DA, 67 AB, 15, 16, 62, 63 B, 74, 77, 106, 111, 112, 118; 214/77 R, 620, 621, 38 CA, 38 D, 392, 513, 130 R, 147 A, 147 AS

[56] References Cited

UNITED STATES PATENTS

| | | | |
|---|---|---|---|
| 1,865,739 | 3/1932 | Bergmann | 294/67 DA |
| 3,402,911 | 9/1968 | O'Neill | 294/67 R |
| 3,823,743 | 8/1974 | Visser | 294/81 SF |

*Primary Examiner*—James B. Marbert
*Attorney, Agent, or Firm*—William S. Rambo

[57] ABSTRACT

A lift frame for cubical loads having disparate centers of gravity featuring a system of pivotally movable truss-like arms which may be extended for attachment to a load or folded for compact transportation or storage. The lift frame also includes a radially and rotationally adjustable lift or hoist connection which may be positioned in alignment with the center of gravity of a load to insure against tilting or overbalancing of the load during lifting and movement thereof.

4 Claims, 7 Drawing Figures

COLLAPSIBLE LIFT FRAME HAVING MEANS TO ADJUST POINT OF LIFT

BACKGROUND OF THE INVENTION

This invention relates generally to a frame for lifting modular building units, shipping containers, or the like. More particularly it relates to a lift frame that may be compactly folded or collapsed to enable it to fit easily into a pickup truck for transportation and which may be adjusted to align the point of lift with the center of gravity of the load being lifted.

In the past, comparatively heavy and bulky loads have been hoisted or lifted by placing them in an embracing sling, cargo net, or chains suspended from the lift ring or hook of a crane or hoist. In some applications the lifting sling has been replaced by a rigid, skeletal lift frame connected between hoisting apparatus and the load to be lifted. A lift frame has the advantage of being more easily attached to a rigid cubical load, and generally simplifies hoisting operations.

However, rigid skeletal lift frames designed to fit large cubical loads are generally quite unwieldy and are extremely difficult to transport and store while fully assembled. Further, since prior lift frames were designed to be suspended from their geometric centers, they were often unsuitable for lifting a load whose center of gravity was located in laterally or radially offset relation to the geometric center of the lift frame. For instance, it has heretofore been impractical to lift a comparatively large, yet fragile, building unit, which has an off-set center of gravity, with any previously known-type of lift frame.

SUMMARY AND OBJECTS OF THE INVENTION

The lift frame of this invention comprises a generally vertically arranged central column or post and four radially outwardly extending, truss-like arms pivotally connected at their inner ends to the central column. Locking means are provided to lock the arms in a generally X-shaped arrangement or pattern for attachment to the load to be lifted. By disengaging the locking means, the arms may be pivoted in a horizontal plane into compact, folded relationship for easy transport or storage.

The lift frame also features a unique hoist attachment means which includes an eyebolt-type lift ring mounted at one end of a lever arm, which is adjustable both radially and rotationally relative to the central column. This lever arm may be rotated about the central column in an orthogonal plane and slid radially in and out from the column to vary the point of lift of the frame in accordance with a particular load situation. By properly adjusting the lever arm, the lift ring can be placed in vertical alignment with the center of gravity of substantially any load.

It is the principal object of this invention to provide an easily transported, foldable lift frame that is capable of lifting loads having asymetrical weight distribution, while at the same time maintaining the load in a level, balanced position.

Another object of this invention is to provide a collapsible lift frame for generally cubical, box-like loads, in which the lift frame is provided with a hoist attaching member which is adjustable, so as to bring the point of lift of the frame and load into vertical alignment with the center of gravity of the load.

For a further and more detailed understanding of this invention, its objects, and its advantages, reference is made to the following description and the accompanying drawings.

DESCRIPTION OF PREFERRED EMBODIMENT OF THE INVENTION

Figure 1:
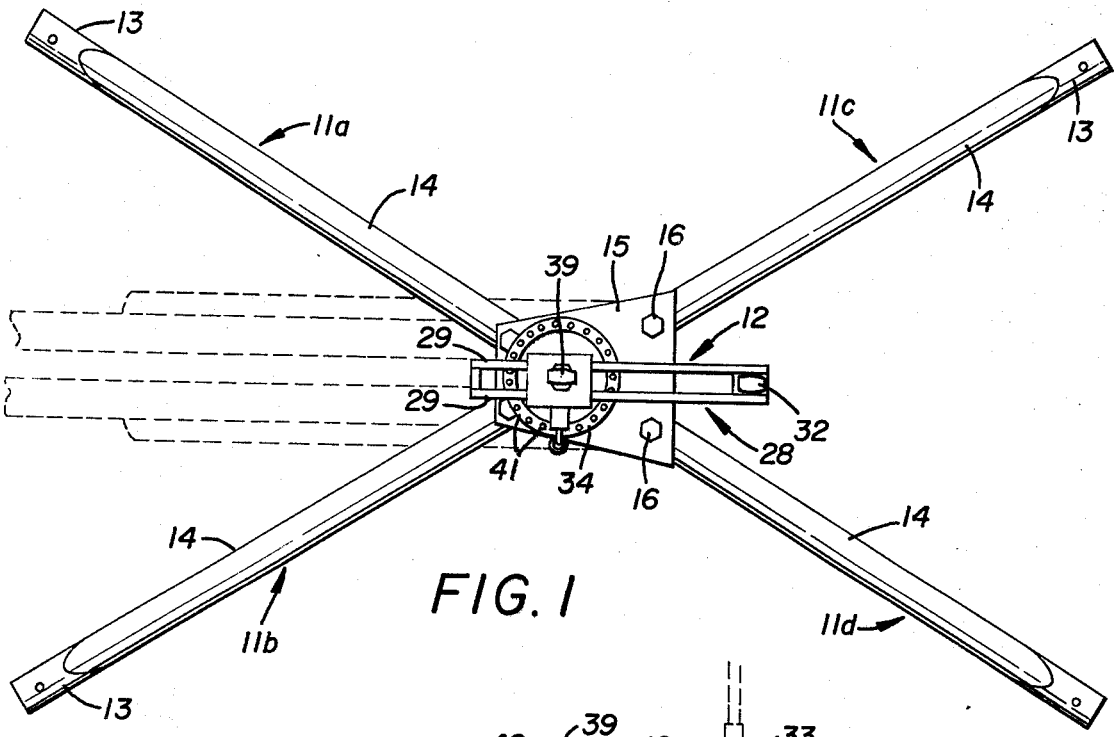
FIG. 1 is a top plan view of lift frame according to this invention.
Figure 2:
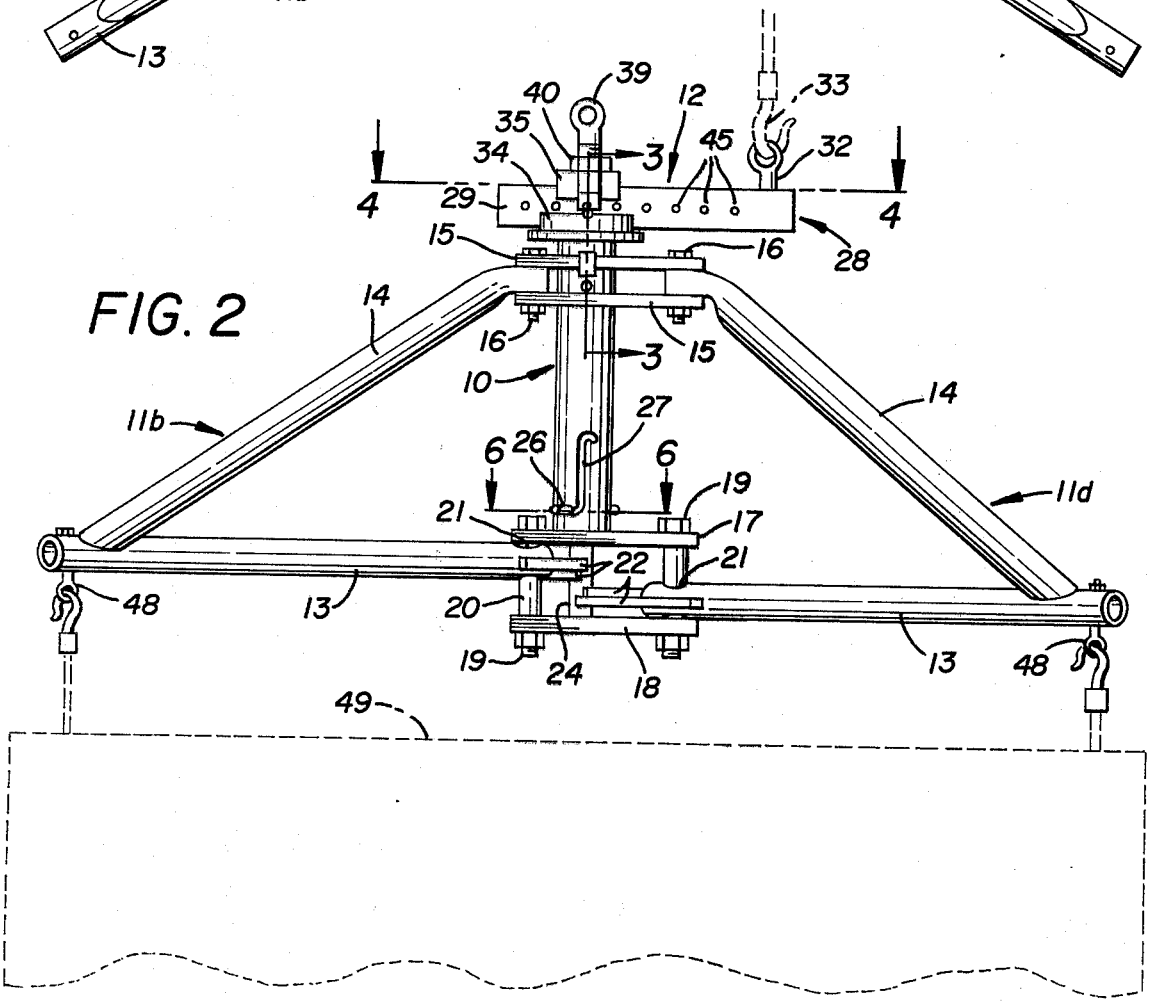
FIG. 2 is a side elevational view thereof.

Referring particularly to FIGS. 1 and 2 of the drawings, the present lift frame comprises, generally, a hollow, vertically arranged, central post or column 10; four V-shaped truss-like arms 11*a*, 11*b*, 11*c*, 11*d*, radiating outwardly from the column and hingedly connected thereto, and a radially and rotationally adjustable hoist attaching or connector assembly 12 by which the frame and its load may be lifted.

Each of the radial arms 11*a*, 11*b*, 11*c*, 11*d* includes a lower tubular compression leg or member 13 extending perpendicularly to and generally beneath the central column 10, and a tubular tension member or brace 14 extending diagonally between the outer end portion of the compression member 13 and the upper portion of the column 10.

Welded adjacent the upper end of the column 10 are a pair of relatively spaced apart trapezoidal plates 15. The inner ends of the diagonal braces 14 of the arms are slightly flattened and are pivotally secured between the corners of the plates 15 by hinge pins or bolts 16. As shown particularly in FIG. 7, a trapezoidal mounting plate 17 is welded to the lower end of the column 10 and a complemental trapezoidal plate 18 is suspended in spaced relation to the plate 17 by means of bolts 19 which pass axially through spacer tubes or sleeves 20 sandwiched between the plates 17 and 18.

The inner ends of the compression members 13 of the arms 11*a*, 11*b*, 11*c* and 11*d* are formed with bushed openings 21 embracing the spacer sleeves 20 to thus provide a hinged connection between the compression members 13 of the arms and the plates 17 and 18.

Figure 5:
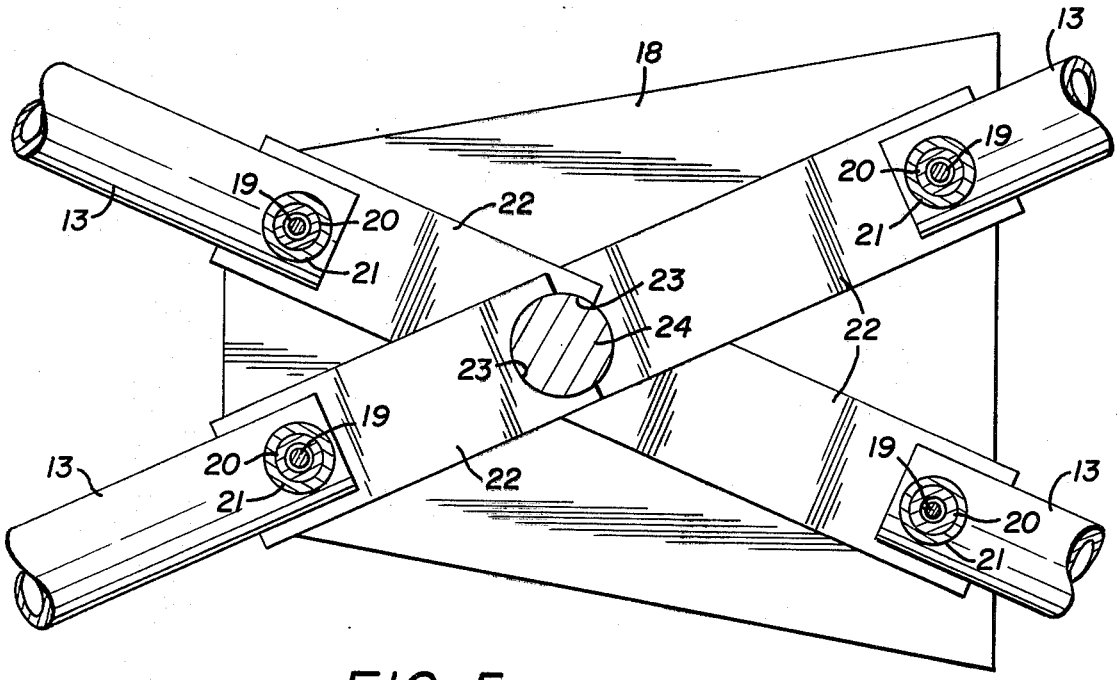
FIG. 5 is a detailed horizontal sectional view taken thru the lower pivot means for the arms of the lift frame approximately along the line 5—5 of FIG. 7.
Figure 7:
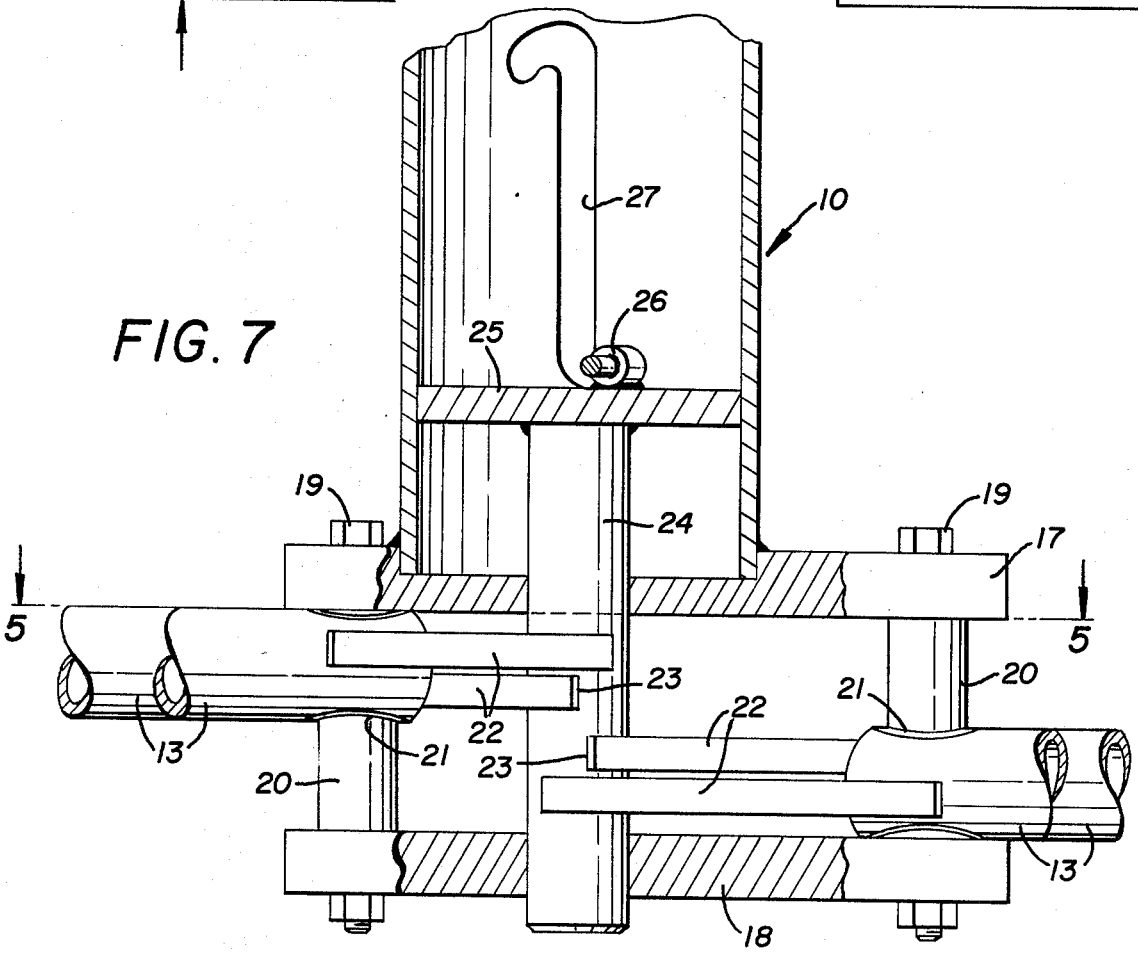
FIG. 7 is a detailed vertical sectional view taken approximately along line 7—7 of FIG. 6.

As shown particularly in FIG. 2, the included angle between the diagonal, tension braces 14 and the compression legs or members 13 of the arms 11*a* and 11*b* is slightly less than the included angle between the corresponding members of arms 11*c* and 11*d*. This produces a slight vertical offset of the inner ends of the compression members 13 of the arms 11*a* and 11*b* relative to the inner ends of the compression members 13 of the arms 11*c* and 11*d*. With reference to FIGS. 5 and 7, it will be seen that the inner end of each of the compression members 13 has welded or otherwise rigidly secured thereto a relatively flat rectangular lock plate or key 22 which forms a rigid axial extension of the member 13. Each of the lock plates or keys 22 terminates in an inner, arcuately notched edge 23 arranged to snuggly embrace a segment of the outer circumferential surface of a vertically arranged, cylindrical locking pin 24 which extends axially through the lower end of the column or post 10 and an opening formed in the plate 17. The locking pin 24 has its upper end welded or otherwise rigidly secured to a circular guide plate or disk 25 slidably carried in the lower end of the tubular column 10. Welded or otherwise secured to the upper surface of the disk 25 is a lifting handle 26 whose opposite ends extend radially outwardly through a pair of diametrically opposed, elongated S-shaped bayonet slots 27 formed in the wall of the column 10.

Figure 6:
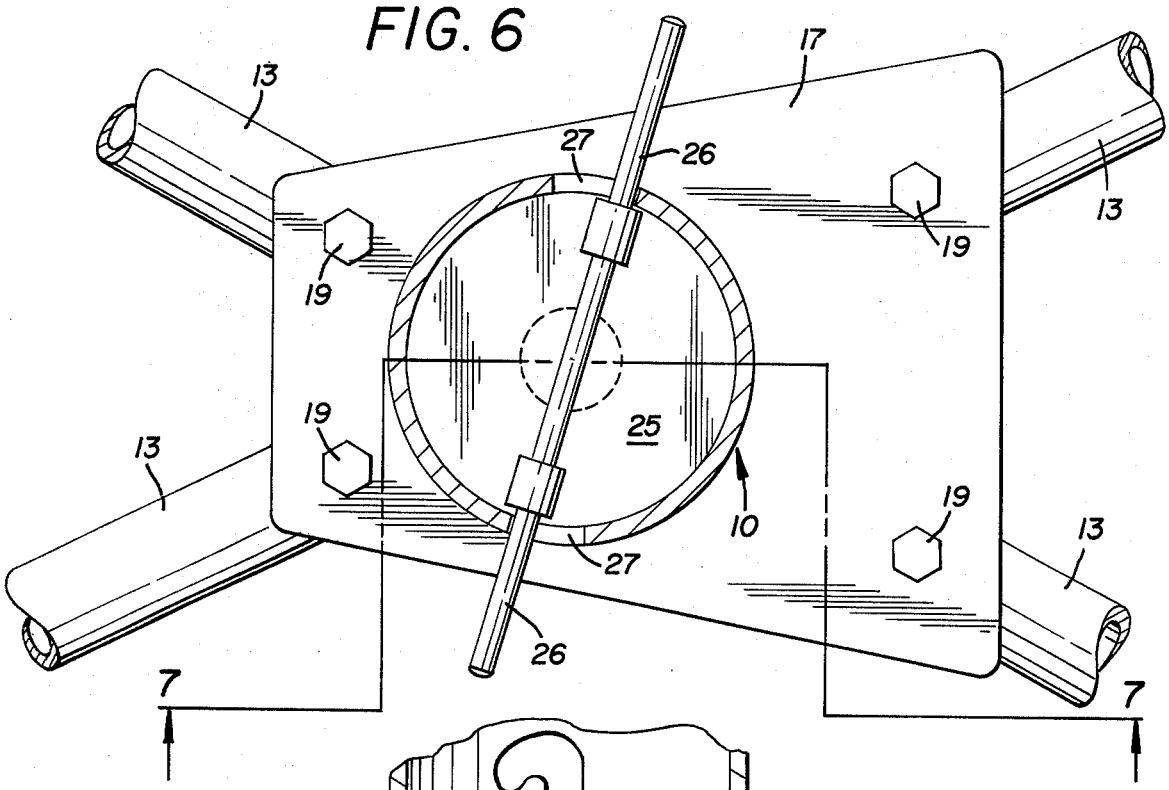
FIG. 6 is a similar view taken along the line 6—6 of FIG. 2.

The disk 25 and the attached locking pin 24 may be raised to disengage the pin 24 from the locking keys 22 simply by turning the handle 26 in a counterclockwise direction (as viewed from FIG. 6) and lifting upwardly upon the handle 26 until it reaches the upper limit of the slots 27. By another slight counterclockwise twist on the handle 26 it may be retained in the upper curve of the S-shaped slots to hold the pin 24 upwardly out of engagement with the keys 22. With the locking pin 24 raised out of engagement with the keys 22, the legs or arms 11*a*, 11*b*, 11*c* and 11*d* are free to pivot or swing about the post or column 10 to a compactly folded position in which the arms are disposed in substantially flat, parallel relation, as indicated by broken lines in FIG. 1.

The hoist attaching assembly 12, by which the frame and its load may be lifted, is adjustably carried on the upper end of the central column above the hinge plates 15. This assembly comprises an elongated, rectangular, box-like slide 28 made up of a pair of relatively spaced parallel side arms 29 connected at their ends by spacer blocks 30 and 31. An eye bolt 32 is welded or otherwise rigidly secured to the spacer block 31 and projects upwardly above the slide 28 at one end thereof to provide a lift ring through which the hook 33 of a crane or hoist apparatus, not shown, may be inserted. The side arms 29 of the hoist attaching assembly are slidably mounted in recesses or ways formed in a circular, flanged disk or cap member 34 rotatably carried on the upper end of the column 10 and in an inverted, stirrup shaped block 35. The block 35 and cap member 34 are formed with central bores through which a screw-threaded connector bolt or stud 36 freely passes. As shown particularly in FIG. 3, the lower end of the bolt 36 is threaded into a circular disk 37 which is carried in the upper end of the column 10, and retained therein by a retainer sleeve 38 press fitted into the upper end of the column 10. The upper end of the bolt 36 terminates in a ring or eye 39, and a jamb nut 40 is threaded onto the bolt 36 below the eye 39 to hold the block 35 in light frictional contact with the upper surfaces of the side arms 29.

The flanged disk or cap member 34 is formed toward its outer edge or periphery with a plurality of circumferentially spaced apart holes or apertures 41, and the cap member 34 may be selectively locked in any one of a number of rotationally adjusted positions by means of a manually releasable, spring-pressed locking pin 42. The locking pin 42 is mounted for vertical sliding movement in a series of relatively spaced apart bearing blocks 43 and 44 welded to the outer side wall of the column 10. Rotational adjustment of the cap member 34 results in a corresponding rotational adjustment of the hoist connecting assembly 12 with respect to the central column 10.

Figure 3:
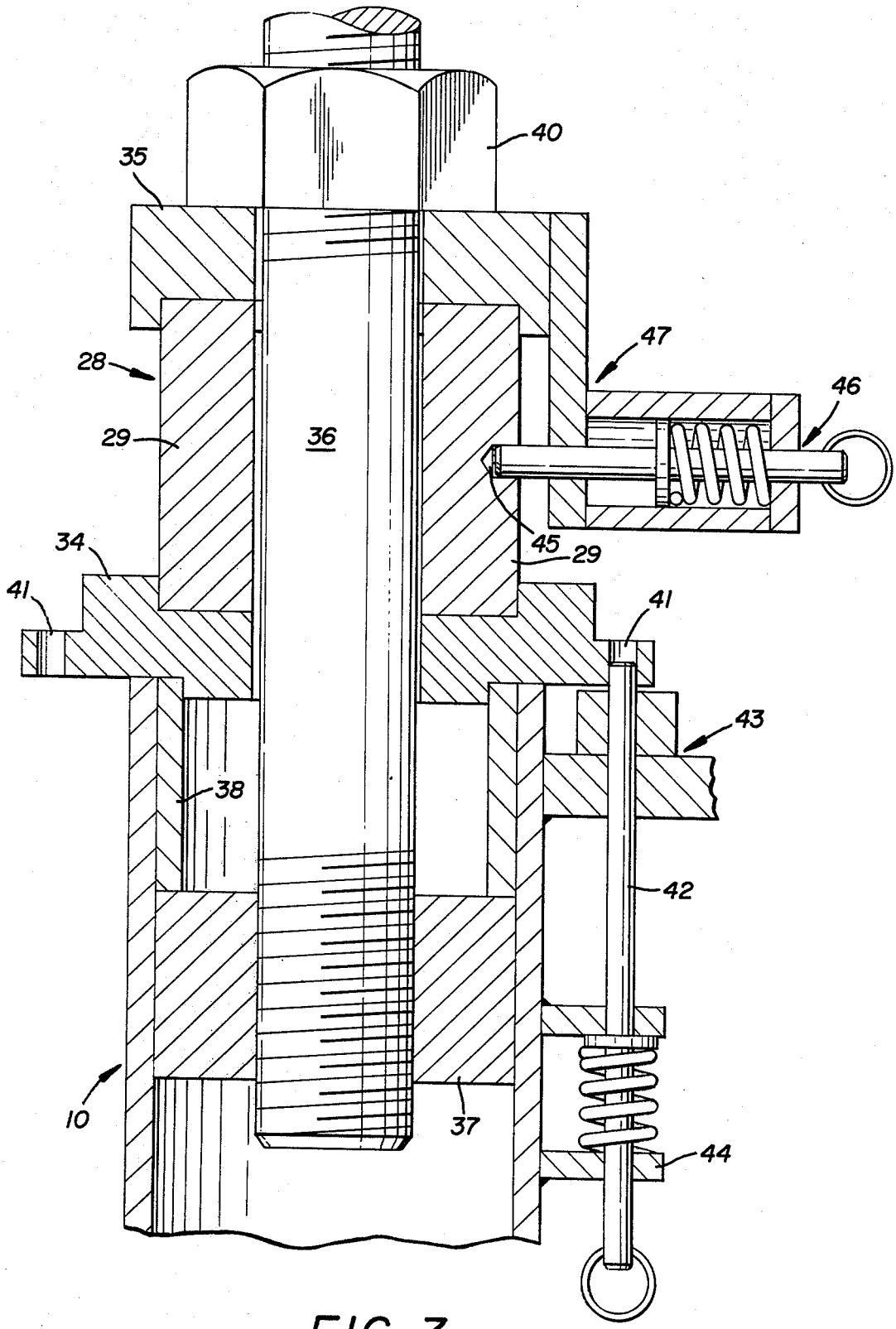
FIG. 3 is an enlarged, fragmentary, vertical sectional view taken through the upper portion of the central column of the frame substantially along the line 3—3 of FIG. 2.
Figure 4:
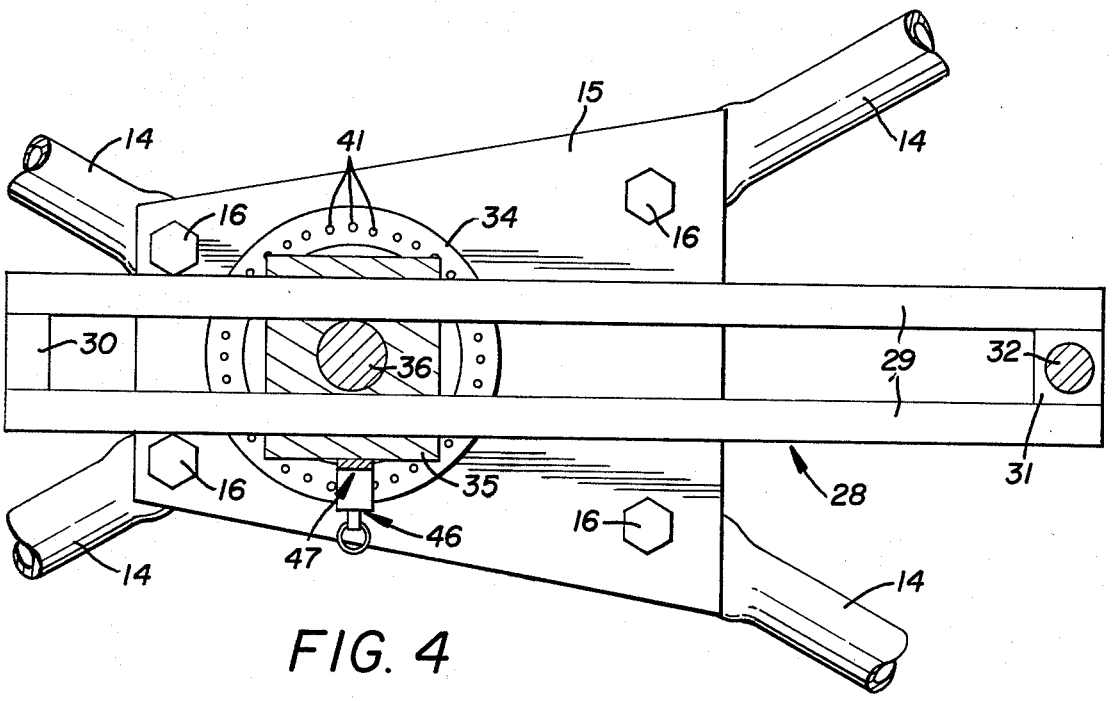
FIG. 4 is a detailed horizontal sectional view taken substantially along the line 4—4 of FIG. 2.

As previously indicated, the hoist connecting assembly 12 is also adjustable radially with respect to the central column 10 of the lift frame and this is accomplished by mounting the parallel side arms 29 of the slide 28 for sliding movement in the ways formed in the cap member 34 and the stirrup block 35. As shown in FIG. 3, the right hand arm 29 of the slide is formed with a series of longitudinally spaced apart openings or apertures 45 which may be selectively brought into alignment with a spring-pressed locking pin assembly 46 carried in a bracket 47 welded to one side of the stirrup block 35. Thus, the slide 28 may be slidably and radially adjusted relative to the central column 10 of the lift frame and locked in any one of a number of selected positions by means of the locking pin assembly 46.

As shown in FIG. 2, a suspension ring or eye bolt 48 may be secured in depending relation to the outer ends of each of the compression legs 13 of the truss-like arms 11*a*, 11*b*, 11*c* and 11*d*, so as to facilitate the attachment and suspension of a load 49 to the lift frame.

OPERATION

As previously indicated, the truss-like arms 11*a*, 11*b*, 11*c* and 11*d* of the lift frame may be folded or collapsed into relatively closely grouped, parallel relation as indicated by broken lines in FIG. 1. In this folded or collapsed position, the lift frame provides a comparatively compact unit to facilitate its storage and transportation to and from a given site of operation.

When it is desired to use the lift frame, the arms 11*a*, 11*b*, 11*c* and 11*d* are pivotally swung outwardly into their relatively spread apart, X-shaped positions as shown by full lines in FIG. 1 and 2. The arms are then locked in their relatively spread apart positions by moving the handle pin 26 downwardly in the S-shaped slots 27 of the column 10 to engage the locking bolt or shaft 24 with the notches 23 in each of the locking keys 22. Also, if desired, a flexible perimeter cable or cables, not shown, may be extended and connected between the outer ends of the compression legs 13 to additionally stabilize and hold the arms of the lift frame in their spread apart, operative positions. The lift frame may then be lifted by initially placing the hook 33 of a crane, derrick or other hoisting apparatus through the centrally located eye 39 of the bolt 36. The frame is then lifted and moved into position above the cubicle load 49 and the eye bolts 48 are secured by cables or chains to the corner portions of the load. If the approximate position of the center of gravity of the load is known, the slide 28 is then adjusted both radially and rotationally on the column 10 by releasing the locking pins 42 and 46, so as to bring the eye or lift ring 32 into approximate vertical alignment with the center of gravity of the load. The pins 42 and 46 are then locked in the nearest apertures, and the hook 33 is then transferred from the center eye bolt 39 to the relatively offset eye or lift ring 32 of the slide. The hoisting apparatus is then operated to place a slight lifting strain on the frame and load to determine whether there is any tendency for the load to tilt or overbalance. If the load appears to be out of balance, it is immediately relowered and the slide 28 is readjusted to more closely position the lift ring 32 in vertical alignment with the apparent center of gravity of the load.

When load balance has been finally achieved by trial and error, the frame and its suspended load may then be lifted and moved with impunity to the desired location. Should it occur that the center of gravity of a particular load is substantially vertically aligned with the geometric center line of the lift frame, it will not be necessary to adjust or use the relatively offset lift ring or eye 32, since the frame and load may be simply lifted from the central eye bolt 39.

As will be readily apparent, the present lift frame is particularly useful in the lifting or hoisting of comparatively large cubical loads, such as prefabricated building units, ship's cargo pallets or boxes, railway box cars, or the like, wherein the center of gravity of the load may be offset from its geometric center.

While a presently preferred embodiment of this invention has been illustrated and described in detail, it will be understood that modifications as to details of construction and design are possible without departing from the spirit of the invention or the scope of the following claims.

I claim:

1. A foldable lift frame comprising:

a. a generally vertically arranged column;

b. a plurality of load-suspending arms extending laterally outwardly from and pivotally connected to said column for swinging movement in a substantially horizontal plane, said arms being movable from relatively compactly folded, inactive positions to extended, outwardly spread positions of use;

c. means engageable with said arms for holding them in their outwardly spread positions of use; and d. hoist connection means carried by said column and providing a point of lift for said frame and a load suspended therefrom.

2. A foldable lift frame according to claim 1, wherein said hoist connection means is adjustable radially and rotationally of said column so as to place the point of lift of said frame in substantial vertical alignment with the center of gravity of a load suspended from said frame.

3. A foldable lift frame according to claim 1, wherein said means for holding said arms in their outwardly spread position of use comprises a single, manually operable locking pin movably carried by said column and engageable with each of said arms when they occupy their outwardly spread positions.

4. A foldable lift frame according to claim 2, including locking means carried by said column and engageable with said hoist connection means for holding the latter in its various positions of adjustment.

* * * * *